US005487283A

United States Patent [19]

Sheppard

[11] Patent Number: 5,487,283

[45] Date of Patent: Jan. 30, 1996

[54] PRESCOUR BLEACHING TUNNEL

[75] Inventor: Sherman H. Sheppard, Pinnacle, N.C.

[73] Assignee: Surry Chemicals, Inc., Mount Airy, N.C.

[21] Appl. No.: 456,528

[22] Filed: Jun. 1, 1995

Related U.S. Application Data

[63] Continuation-in-part of Ser. No. 282,209, Jul. 28, 1994, Pat. No. 5,426,958, which is a continuation-in-part of Ser. No. 67,516, May 24, 1993, Pat. No. 5,333,475.

[51] Int. Cl.[6] ..... D06F 23/02

[52] U.S. Cl. ..... 68/27; 68/142; 68/184; 68/207

[58] Field of Search ..... 68/27, 24, 58, 68/40, 139, 142, 143, 173, 184, 207; 8/159

[56] References Cited

U.S. PATENT DOCUMENTS

| | | | |
|---|---|---|---|
| 3,869,883 | 3/1975 | Rotter | 68/58 |
| 4,478,060 | 10/1984 | Grunewald | 68/27 |
| 4,546,511 | 10/1985 | Kraufmann | 68/207 |
| 4,848,107 | 7/1989 | Stoll | 68/27 |
| 4,856,302 | 8/1989 | Eck | 68/27 |
| 4,984,438 | 1/1991 | Batty | 68/27 |
| 5,307,652 | 5/1994 | Nagiwara et al. | 68/27 |
| 5,333,475 | 8/1994 | Edmundson et al. | 68/27 |

FOREIGN PATENT DOCUMENTS

| | | |
|---|---|---|
| 4204851A1 | 9/1992 | Germany . |
| 2064576 | 6/1981 | United Kingdom . |

*Primary Examiner*—Frankie L. Stinson
*Attorney, Agent, or Firm*—Rhodes, Coats & Bennett

[57] ABSTRACT

A conventional tunnel-type continuous batch washer modified for use as a commercial bleaching machine. The washer is modified by (1) lowering the rotational oscillation angle and speed of the machine's inner drum structure relative to its normal washing settings; (2) altering the water counterflow positioning and characteristics; (3) maintaining the water in the various inner drum section modules at essentially identical, relatively high levels; and (4) modifying the bath temperature characteristics of the machine. When utilized as a commercial bleaching machine the modified tunnel washer has a prescour zone disposed at its inlet end, a bleach zone downstream of the prescour zone and into which a hydrogen peroxide bleaching solution is injected, a finish zone disposed at its outlet end and into which a softening agent is injected, and a water-only rinse zone positioned between the bleach and finish zones. Each of these zones is defined by one or more inner drum structure modules which may be tandem or single batch modules. The bleaching machine is representatively used to bleach originally manufactured white textile fabric items, such as athletic socks and undergarments, prior to their packaging for sale.

20 Claims, 1 Drawing Sheet

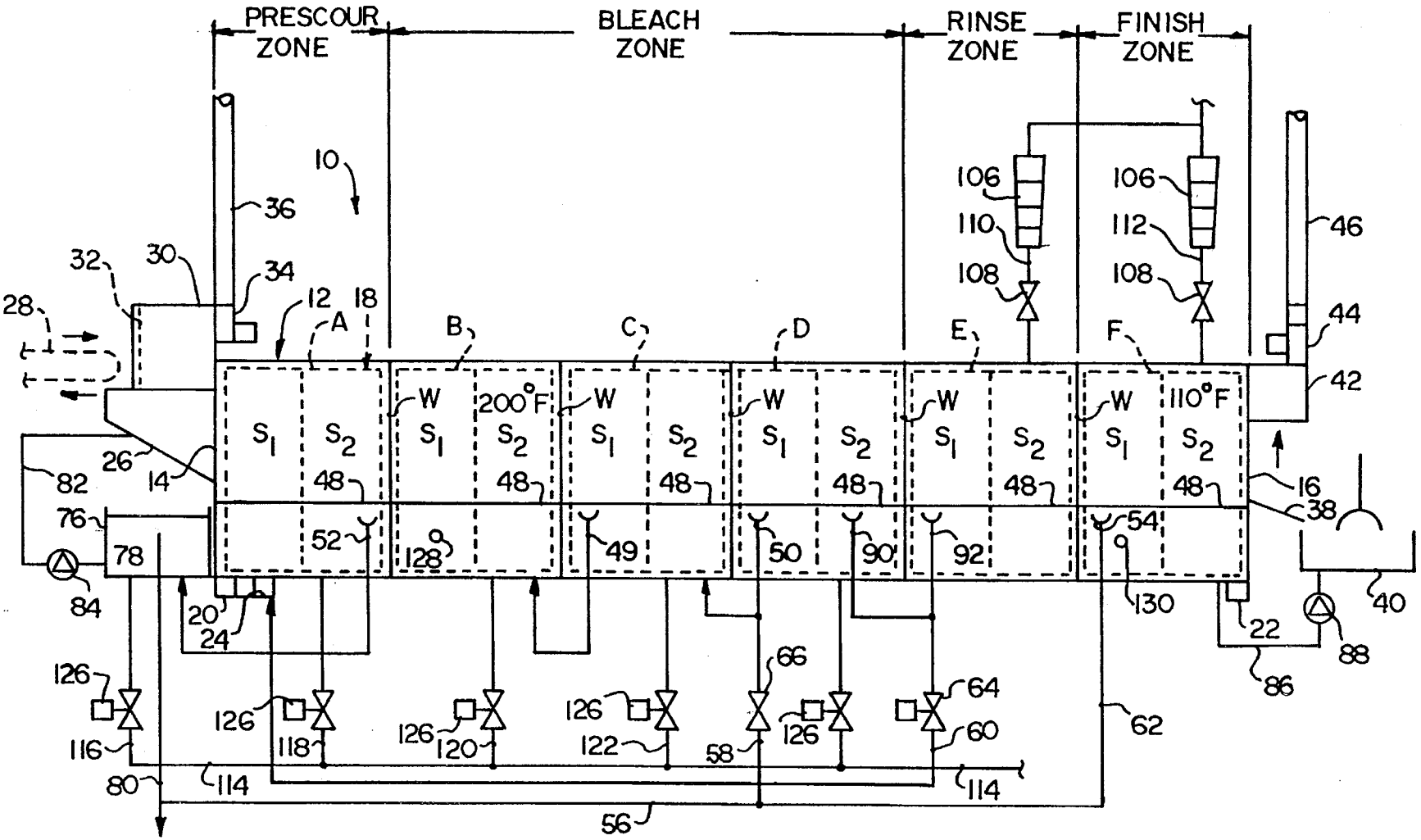
FINISH ZONE
RINSE ZONE
BLEACH ZONE
PRESCOUR ZONE
110°F
200°F
W
S1
S2
A
B
C
D
E
F
10
12
14
16
18
20
22
24
26
28
30
32
34
36
38
40
42
44
46
48
49
50
52
54
56
58
60
62
64
66
76
78
80
82
84
86
88
90
92
106
108
110
112
114
116
118
120
122
126
128
130

PRESCOUR BLEACHING TUNNEL

CROSS-REFERENCE TO RELATED APPLICATIONS

The present application is a continuation-in-part of U.S. patent application No. 08/282,209, filed Jul. 28, 1994 (now U.S. Pat. No. 5,426,958, issued Jun. 27, 1995), which, in turn, is a continuation-in-part of U.S. patent application No. 08/067,516, filed May 24, 1993 (now U.S. Pat. No. 5,333, 475, issued Aug. 2, 1994).

BACKGROUND OF THE INVENTION

1. Field of the Invention

The present invention relates generally to an apparatus for bleaching manufactured white textile fabric items, such as athletic socks, undergarments and the like, prior to their packaging for sale and, more particularly, to a uniquely modified tunnel-type continuous batch washer used to sequentially carry out the various phases of this commercial bleaching process.

2. Description of the Prior Art

In the manufacture of a variety of white textile fabric goods, such as athletic socks, undergarments and the like, it is necessary to bleach the goods before they are packaged for sale since when the fabric goods are initially finished they tend to have a yellowish-gray appearance instead of the bright white color that consumers have become accustomed to over the years. Conventional bleaching processes for these types of white textile fabric goods have traditionally utilized a sodium hypochlorite bleach in one of two types of commercial bleaching machines.

The first type of bleaching machine is commonly referred to as a washer/extractor unit in which all of the bleaching steps, such as bleaching, rinsing and draining, are performed on a stand-alone batch of textile fabric items in a single chamber within the machine. For example, the items are bleached in the chamber; the bleaching liquid is drained from the chamber and replaced with water to rinse the bleached items; the rinse water is drained from the chamber and a softening liquid is added; and the items are finally drained and extracted and transferred to suitable drying apparatus. The washer/extractor unit thus functions quite similarly to a household washing machine, but on a much larger scale. As is well known, this type of bleaching apparatus has an undesirably low batch processing rate, and tends to use an undesirably high quantity of water and chemicals for each pound of textile fabric items being processed.

The other type of machine conventionally used in this bleaching application is commonly referred to as a "paddle tub" machine and comprises an open-topped vat or tub in which bleaching liquid is disposed (and later rinse water) and covers the textile items being bleached. A paddle mechanism disposed above the liquid is driven through an upper portion thereof to create a liquid flow pattern which agitates the items, and enhances the bleaching process, without creating mechanical contact between the paddle structure and the items being bleached. The typical paddle tub machine tends to be relatively expensive, is mechanically complex, and has a relatively slow batch processing rate. Additionally, it has a fairly high water usage rate, typically on the order of 8–15 gallons of water per pound of goods being processed, and a high energy usage rate.

The grandparent application of the present invention was directed to a conventional tunnel-type continuous batch washer which was modified for use as a commercial bleaching machine by (1) lowering the rotational oscillation angle and speed of the machine's inner drum structure relative to its normal washing settings; (2) altering the water counterflow positioning and characteristics; (3) maintaining the water in the various inner drum section modules at essentially identical, relatively high levels; and (4) modifying the bath temperature characteristics of the machine. When utilized as a commercial bleaching machine the modified tunnel washer included a bleach zone disposed at its inlet end and into which a hydrogen peroxide bleaching solution is injected, a finish zone disposed at its outlet end and into which a softening agent is injected, and a water-only rinse zone positioned between the bleach and finish zones. Each of these three zones was defined by one or more inner drum structure modules which may be tandem or single batch modules. While this machine was a dramatic improvement over conventional bleaching ranges, it was found that its performance could even further improved by additions and improvements to its control system. The present invention is based on utilizing the zones in a different manner to provide a prescour zone upstream of the bleaching zone for bleaching more difficult goods.

Thus, there remains a need for a new and improved commercial bleaching apparatus which further eliminates or at least substantially minimizes the above-mentioned problems, limitations and disadvantages commonly associated with conventional bleaching apparatus of the type generally described above.

SUMMARY OF THE INVENTION

The present invention is directed to an improved bleaching range which consists of a conventional tunnel type continuous batch washer which is uniquely converted into a bleaching machine for use in bleaching textile fabric items, such as athletic socks, undergarments and the like, prior to their packaging for sale.

The bleaching machine of the present invention comprises a horizontally disposed drum structure having an open inlet end into which textile goods to be bleached may be inserted, and an open outlet end through which bleached textile goods may be discharged. The drum structure, preferably the drum structure of a tunnel type continuous batch washer, has stationary, hollow, generally cylindrical outer wall means, and perforated hollow cylindrical inner wall means concentrically disposed within the outer wall means and being operatively drivable relative thereto in a manner alternately oscillating the inner wall means through a rotational arc of less than 360° and then rotating the inner wall means through a full 360° arc.

The interior of the outer wall means is axially divided into a prescour zone positioned at the inlet end of the drum structure, a rinse zone positioned at the outlet end of the drum structure, and a bleach zone positioned between the prescour and rinse zones, and the interior of the inner wall means is divided into axial sections received in the prescour, bleach and rinse zones. The inner wall means, in response to successive rotations thereof through full 360° arcs, are operative to axially shift textile goods from section to section thereof, toward the open outlet end of the drum structure, and then outwardly through the open outlet end. Drive means are provided for operatively driving the inner wall means relative to the outer wall means.

Makeup means are provided for continuously flowing water through the prescour and rinse zones to waste in a manner maintaining essentially constant, equal heights of water in lower side portions of the prescour and rinse zones and in the sections of the inner wall means disposed therein. Recirculating means are additionally provided for maintaining an essentially constant height of water in the bleach zone essentially equal to the water heights in the prescour and rinse zones. The recirculating means include a makeup water tank mounted on the inlet end of the drum structure, means for draining water from the bleach and rinse zones into the makeup water tank, and means for periodically transferring water from the makeup water tank back into the bleach zone.

The bleaching machine of the present invention also includes heating means for heating water disposed in the prescour, bleach and rinse zones of the machine, and means for selectively adding a bleaching agent to the bleach zone.

During use of the bleaching machine, successive batches of textile goods to be bleached are deposited into the inlet end section of the inner wall means, rotationally oscillated through the water/bleaching agent mixture therein, and then transferred to the next adjacent inner wall means section where the oscillation and axial transfer process is repeated. When the textile goods batch exits the drum structure, after having been prescoured, bleached and rinsed, it is deposited into an extractor press structure which operates to remove moisture from the batch. The batch is then removed from the extractor, to make room for the next textile goods batch, and transferred to a suitable drier.

In addition to the recirculating water flow through the bleach section of the machine, which permits the bleaching agent added thereto to be recycled, and the maintenance of an essentially constant water level throughout the machine, various other features and modifications are incorporated in the preferred embodiment of the machine which uniquely permit it to function as a bleaching machine. These features and modifications include:

1. Rotationally oscillating the inner wall means through an arc of approximately 240°, an arc substantially less than the arc used when a laundry function is being performed by the machine;
2. Maintaining an overall inner wall means rotational speed of approximately 5 RPM, a rotational speed substantially less than the rotational speed maintained when a laundry machine is being performed by the machine;
3. Maintaining the water volumes in the prescour, bleach and rinse zones at approximately 27% of the total volumes of such zones such that the water heights in the inner wall means sections are essentially constant along the length of the drum structure; and
4. Maintaining progressively lower water temperatures in the prescour, bleach and rinse zones, preferably about 150° F. in the prescour zone, about 200° F. in the bleach zone, and a water temperature ranging from about 180° F. to about 130° F. in the rinse zone.

In a preferred embodiment of the commercial bleaching machine the interior of the outer wall means is axially divided into a series of modules defining the prescour, bleach and rinse zones, and the inner wall means have two sections thereof rotatably disposed in each of the modules.

Compared to conventional bleaching machines, such as single chamber washer/extractor units and paddle tub machines, the bleaching machine of the present invention provides for faster processing speeds, increased safety, and lessened water and chemical usage.

These and other aspects of the present invention will become apparent to those skilled in the art after a reading of the following description of the preferred embodiment when considered with the drawings.

BRIEF DESCRIPTION OF THE DRAWINGS

The single drawing figure is a highly schematic diagram of a representative tunnel-type continuous batch washer modified according to the present invention to carry out a textile bleaching process as opposed to its usual continuous batch washing process.

DESCRIPTION OF THE PREFER#ED EMBODIMENTS

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the figure, it will be understood that the illustrations are for the purpose of describing a preferred embodiment of the invention and are not intended to limit the invention thereto. As schematically depicted in the single drawing figure, the present invention provides a specially designed commercial bleaching machine 10 used to bleach originally manufactured white textile fabric goods, such as athletic socks, undergarments and the like, prior to their packaging for sale. The machine 10 is a conventional tunnel type, continuous batch washer which has been uniquely modified to convert it into a highly efficient bleaching machine whose operation will be subsequently described herein. Representatively, the machine 10 is a series UT Ultratandem continuous batch washer as manufactured by the Boewe Passat Drycleaning and Laundry Machinery Corporation, 2700 Commerce Street, Wichita Falls, Tex. 76303.

Bleaching machine 10 has an elongated cylindrical body defined by a horizontally oriented metal outer drum structure 12 which is typically supported on a work space floor area by an underlying cradle support structure (not shown). Outer drum 12 is a stationary structure having an open left or inlet end 14, and an open right or outlet end 16. Coaxially secured within the outer drum 12, and internally extending between its opposite ends, is a hollow cylindrical inner drum structure 18 which is rotatable relative to the outer drum structure 12 by a pair of drive motors 20,22 disposed on the opposite ends of the outer drum structure 12 and drivingly connected to the inner drum structure 18 through a variable speed drive structure 24.

From left to right along the body of the machine 10, vertical interior wall portions W of the outer drum structure 12 separate the inner drum structure 18 into interconnected, simultaneously rotatable hollow cylindrical modules A–F. Each inner drum section module A–F communicates with all the other modules via central openings formed in the wall sections W and the individual modules. Additionally, each of the modules A –F is horizontally divided into two communicating sections $S_1$ and $S_2$ by internal transfer wall structures (not shown). The outer ends of modules A and F have central openings therein which communicate with the central inlet and outlet openings respectively formed in the ends 14,16 of the outer drum structure 12.

During use of the machine 10 in a manner subsequently described, the inner drum structure 18 is rotationally oscillated through a predetermined arc of less than 360° to continuously agitate batches of textile fabric goods and associated chemical process liquids disposed within the sections $S_1$ and $S_2$ in each of the inner drum modules A–F. Although the modules A–F are separated from one another by the wall sections W, the two sections $S_1$ and $S_2$ of each module communicate with one another through a common central transfer opening and perforations in their wall structures. Accordingly, the liquid in each module is common to each of its sections $S_1$ and $S_2$.

Supported at the open left or inlet end of the machine 10 is an open-topped loading funnel 26 operatively positioned at the discharge end of a batch loading conveyor 28. A vent hood 30, having an open, curtained front side 32, is positioned over the top of the funnel 26 and is operatively connected to the inlet of a suitable exhaust fan 34 having its outlet connected to a vent stack 36. During initial operation of the machine 10, the conveyor 28 is energized to drop a batch of textile fabric goods (not shown) into the top side of the funnel 26 for gravity delivery into the first section $S_1$ of module A. The batch is then rotationally oscillated in the liquid within the module A section $S_1$ for a predetermined cycle time.

At the end of this cycle time the inner drum structure 18 is rotated through a full 360° arc to cause the previously mentioned transfer wall means within module A to automatically shift the textile fabric batch from section $S_1$ within module A to section $S_2$ therein. Another batch of textile goods is then dropped into the now vacant section $S_1$ of module A. At the end of the subsequent processing cycle the inner drum structure 18 is again rotated through a full 360° arc, to cause the conventional inner drum structure transfer wall means automatically transfer each textile batch one inner drum section to the right, and another textile batch is added to the again vacant section $S_1$ of module A.

When the initially loaded batch reaches section $S_2$ of module F, and is then ejected therefrom out the open outlet end 16 of the machine 10, the batch slides down a chute 38 into a conventional extractor press 40 which operates to extract moisture from the textile batch which is then appropriately transferred to a drying station to ready the extractor press for the next textile batch discharged from the outlet end of the machine 10. A vent hood 42 is positioned over the chute 38 and is connected to the inlet of a suitable exhaust fan 44 whose outlet is coupled to a vent stack 46.

Machine 10, in its conventional configuration, is particularly well suited to commercial laundry applications due to its rapid processing speed and thorough, direct mechanical agitation of the fabric goods being axially transferred through the machine and being pre-washed, washed and then rinsed therein. Because of the highly effective mechanical washing action built into the machine 10 it would, at first glance, not seem a likely candidate for use as a commercial bleaching machine since commercial bleaching methods are primarily chemical treatment processes (as opposed to cleaning processes) in which a minimal mechanical action on the goods being processed is the norm. However, the various unique modifications made to the machine 10 to convert it into a commercial bleaching machine render it surprisingly effective in its new role. In fact, the modified machine 10 provides a variety of advantages over conventional dedicated bleaching machines including increased processing speed, lowered water and chemical consumption, enhanced worker safety, and reduced energy usage.

In its use as a commercial bleaching machine the machine 10 is representatively divided into a prescour zone defined by the inlet end module A; a bleach zone defined by intermediate modules B, C and D; a rinse zone defined by module E; and a finish zone defined by the outlet end module F. To convert the machine 10 from its conventional use as a laundry machine to its new use as a bleaching machine, both fluid circuitry and operational modifications are made to the machine. The fluid circuitry associated with the modified machine will now be described.

During operation of the bleaching machine 10, water 48 is maintained at essentially equal heights in lower side portions of the modules A–F below the central transfer openings in their modules $S_1$ and $S_2$. Equal height discharge weirs 50, 52 and 54 are respectively disposed within the modules D,E and F and are connected to a main sewer drain line 56 by branch drain lines 58,60 and 62.

In the grandparent application, manual shutoff valves 64, 66 were disposed in the branch drain lines 58 and 60. However, in the parent invention, automatic shut off 64 were disposed in the branch drain line 58 and a manual shut off valve being disposed in the branch drain line 60. This arrangement provided a means by which water was supplied to Module C when automatic shut-off 64 is closed.

A liquid transfer line 68, having a manual shutoff valve 70 therein, was connected between the underside of the module C and the branch drain line 58 above the valve 64. In a similar manner a liquid transfer line 72, having a manual shutoff valve 74 therein, was connected between the underside of the module D and the branch drain line 60 above the valve 66.

Mounted on the inlet end 14 of the machine 10, beneath the loading funnel 26, is a makeup water tank 76 having an outlet weir 78 disposed therein and connected to the main sewer drain line 56 by a branch drain line 80. The makeup water tank 76 is connected to the loading funnel 26 by a flushing line 82 in which a recirculating pump 84 is operatively installed. At the outlet end 16 of the machine 10 the batch receptacle portion of the extractor press 40 is connected to the underside of module F by a liquid transfer line 86 in which a recirculating pump 88 is operatively installed.

In the grandparent application, outlet weirs 90 and 92, having heights equal to those of weirs 50,52 and 54, were respectively disposed in the modules B and C and were connected, via branch lines 94 and 96, to a makeup water line 98 in turn connected to the underside of the water tank 76. Lower interior portions of the modules A and B were communicated by a liquid transfer line 100.

Also, in the grandparent application, preheated inlet water was respectively supplied to the modules C and D via supply lines 102,104 in each of which a visual flow indicator 106 and a manual flow regulator valve 108 was installed. In a similar manner, unheated makeup water was respectively supplied to the modules E and F via supply lines 110,112 in each of which a visual flow indicator 106 and a manual flow regulator valve 108 was installed.

However, in the parent invention, outlet weirs 90 and 92, having heights equal to those of weirs 49, 50, 52 and 54 were respectively disposed in the modules B and C and are connected, via branch lines 94 and 96, to a makeup water line 98 in turn connected to the underside of the water tank 76. Lower interior portions of the modules A and B were communicated by a liquid transfer line 100.

Also, in the parent invention, weirs 49 and 50 were connected via branch line 95 and were respectively disposed in the modules C and D.

Finally, in the parent invention, preheated inlet water was supplied to the modules D, E and F via supply lines 104, 110 and 112 in which a visual flow indicator 106 and a manual flow regular valve 108 is installed. This arrangement provided a means to inject variable amounts of water into each module.

Water in the makeup tank 76 and the modules A–D is heated using a suitable supply of steam fed thereto via a main steam supply line 114 and branch lines 116,118,120, 122 and 124 having thermostatically controlled steam supply valves 126 operatively installed therein. In the present invention, the valves are set in a manner such that during operation of the bleaching machine 10 the water 48 in the modules A is maintained at approximately 150° F., modules B,C and D is maintained at approximately 200° F.; and the water 48 in module E is maintained at between approximately 180° F. to 130° F. With these settings, the nonheated module F operates at water temperatures of approximately 110° F. This staged temperature decrease in modules E and F serves to substantially inhibit wrinkling of the textile goods being processed which might otherwise result from thermal shocking of such goods. For purposes later described, chemical injection ports 128 and 130 are respectively formed in the modules A and F.

Operation of the Improved Bleaching Machine

During operation of the Bleaching Machine 10, a bleaching agent, preferably a hydrogen peroxide bleaching agent is injected as needed into the bleach module via port 128 and a finishing agent, preferably a cationic softening agent, is injected as needed into the finish module via port 130. Each successive batch of textile goods to be bleached is initially deposited by the conveyor 28 into the loading funnel 26 and slides down the funnel into the inner drum section $S_1$ of module A. The initial delivery of each textile goods batch to module A is facilitated by starting the recirculating pump 84 to deliver water from tank 76 to the funnel 26.

In the grandparent application, this temporarily delivered water helped to carry the batch down the funnel 26 into the inner drum structure. It also created a recirculating counterflow of water from the bleach zone, and module C of the rinse zone, through the makeup tank 26 and back into the bleach zone. This advantageously permitted the bleaching solution to be recycled during operation of the machine 10.

However, in the parent invention, the recirculating pump 84 created a clockwise bleaching solution flow-thru the bleach zone exiting out of Module B via weir 90 into connecting drain line 98 to water make up tank, 76. As water is absorbed by the goods being introduced into the bleaching tunnel or carried with the goods as they transfer thru the modules, water must be added to the bleach zone.

Also, in the parent invention, Module A, Module B, Module C and water make up tank 76 was equipped with level switches. As water was needed, automatic shut off 64 in Module D closes, rinse water containing bleaching solution was recycled via branch line 95 into weir 49 thru Module C exiting weir 48 branch line 96 to makeup water water line 98 in turn connected to water makeup tank 76 and delivered via recirculating pump 84 to Module A and/or B, if needed. As all levels are met, whether Module A, Module B, Module C, and/or water make up tank 76, automatic shut off 64 opens and water exits branch line 58 to main sewer drain 56.

Thus, in the parent invention, the isolation of bleach solution in Module A, Module B and the water make up tank 76 was critical to the function of the bleaching tunnel. The counterflow of rinse water containing bleaching chemical solution from Module D, via preheated water supply 104, thru Module C reduced the preheated water consumption by 0.6 gallon per pound of goods processed.

Since, the water consumption or usage in the rinse zone is a function of neutralization of the goods and dilution for environmental waste water concerns, the rinse water recycling in the parent invention resulted in improved bleaching chemical solution utilization and decreased environmental waste water impact without preheated water addition or negative effect on waste water parameters.

In the present invention, makeup water is supplied to module A via drain line 60 from module E. Makeup water flowing from module A exits weir 52 into the makeup water tank 76 and overflows to waste via weir 78. Recirculation pump 84 flushes water as goods enter into the tunnel from the makeup water tank.

Also, in the present invention, modules B, C and D are connected via weirs of equal height 49, 50 and 90 with bleach solution to all in common. Periodically water is supplied from the rinse zone (module E) back into the bleach zone (modules B,C and D). Bleach solution is supplied via line 128 into module B. Makeup water is supplied via preheated water line 110 and exits module E via weir 92.

Thus, in the present invention, the use of module A as a prescour zone to remove the contaminates of the goods prior to the goods entering the bleach zone yields a more effective bleaching function by utilizing the spent bleach solution that previously had gone to waste from the rinse zone (module E).

As each batch of textile goods is rotationally oscillated in one inner drum section, and then axially advanced rightwardly into the next drum section, it is sequentially subjected to a prescour, a bleaching process, a water-only rinse, and a softening or finishing process before being ejected into the extractor press 40. According to features of the present invention, the inner drum structure 18 is rotationally driven at approximately 5 RPM and is oscillated through an arc of approximately 240°—each of these values being selectively adjustable and substantially lower than when the machine is conventionally utilized in a laundry process.

As previously mentioned, in contrast to when the machine 10 is used as a laundry machine, the water levels in the modules A–F are maintained at essentially constant heights along the length of the machine. Preferably, this is achieved by maintaining the water volumes within the range of from about 25 to 30 percent of their associated module volumes. Most preferably, this water volume is approximately 27 percent of each module volume.

The overall combination of modifications made to the machine 10 to convert it from a laundry machine to a bleaching machine as discussed above—namely, (1) the prescour/bleach/rinse/finish process orientation, (2) the maintenance of constant water heights within the various machine modules, (3) the substantial lowering of the drum rotational speed and oscillation angle, (4) the bleach zone water recirculation, and (5) the progressive water temperature reduction along the length of the drum structure—provides the machine 10 with a highly effective bleaching capability. Compared to conventional bleaching machines such as washer/extractor units and paddle tub machines, the bleaching machine 10 of the present invention provides faster process rates, increased worker safety, substantially reduced water and chemical usage rates, and lowered energy usage.

Certain modifications and improvements will occur to those skilled in the art upon a reading of the foregoing description. By way of example, installation of an automatic shut-off valve on Modules E and F may result in further reduced water consumption and better utilization of the bleaching liquor. Also, the above and similar improvements in water and chemical utilization may decrease the number of modules necessary to process the textile goods. It should be understood that all such modifications and improvements have been deleted herein for the sake of conciseness and readability but are properly within the scope of the following claims.

I claim:

1. Commercial bleaching apparatus comprising:

a horizontally disposed drum structure having an open inlet end into which textile goods to be bleached may be inserted, and an open outlet end through which bleached textile goods may be discharged, said drum structure having stationary hollow cylindrical outer wall means, and perforated hollow cylindrical inner wall means concentrically disposed within said outer wall means and being operatively drivable relative thereto in a manner alternately oscillating said inner wall means through a rotational arc of less than 360° and then rotating said inner wall means through a full 360° arc, the interior of said outer wall means being axially divided into a prescour zone positioned at said inlet end and bleach and rinse zones positioned downstream of said prescour zone, and the interior of said inner wall means being divided into axial sections received in said prescour, bleach and rinse zone, said inner wall means, in response to successive rotations thereof through full 360° arcs, being operative to axially shift textile goods from section to section thereof, toward said open outlet end, and then outwardly through said open outlet end;

drive means for operatively driving said inner wall means relative to said outer wall means;

makeup means for continuously flowing water through said rinse zone first to said prescour zone and then to waste in a manner maintaining essentially constant, equal heights of water in lower side portions of said rinse and said prescour zones and in the sections of said inner wall means disposed therein;

recirculating means for maintaining an essentially constant height of water in said bleach zone essentially equal to the water heights in said rinse and said prescour zones, said recirculating means including means for periodically transferring water from said rinse zone back into said bleach zone;

heating means for heating water disposed in said prescour, bleach and rinse zones; and means for selectively adding a bleaching agent to said bleach zone.

2. The commercial bleaching apparatus of claim 1 wherein said drum structure is the drum structure of a tunnel type continuous batch washer.

3. The commercial bleaching apparatus of claim 1 wherein said rotational arc through which said inner wall means are oscillated is approximately 240°.

4. The commercial bleaching apparatus of claim 1 wherein said drive means are operative to rotationally drive said inner wall means relative to said outer wall means at about 5 RPM.

5. The commercial bleaching apparatus of claim 1 wherein said makeup means and said recirculating means are operative to maintain volumes of water in said prescour, bleach and rinse zones equal to from about 25% to about 30% of the total volumes of said prescour, bleach and rinse zones.

6. The commercial bleaching apparatus of claim 5 wherein said volumes of water in said prescour, bleach and rinse zones are equal to about 27% of the total volumes of said prescour, bleach and rinse zones.

7. The commercial bleaching apparatus of claim 5 wherein said makeup means and said recirculating means include equal height overflow weir box means associated with said prescour, bleach and rinse zones and operative to drain water from lower side portions thereof.

8. The commercial bleaching apparatus of claim 1 wherein said heating means include means for injecting steam into said prescour, bleach and rinse zones.

9. The commercial bleaching apparatus of claim 8 wherein said heating means are operative to maintain water temperatures within said drum structure that progressively decrease from said bleach zone to said rinse zone.

10. The commercial bleaching apparatus of claim 9 wherein said heating means are operative to maintain a water temperature of approximately 150° F. in said prescour zone, approximately 200° F. in said bleach zone and a water temperature ranging from about 180° F. to about 130° F. in said rinse zone.

11. The commercial bleaching apparatus of claim 1 wherein said commercial bleaching apparatus further comprises loading funnel means connected to said open inlet end of said drum structure for receiving successive batches of textile goods to be bleached and delivering the batches into the inlet end section of said inner wall means, and said means for periodically transferring water from said makeup water tank back into said bleach zone include circulating pump means operative to intermittently deliver water from said makeup water tank to the interior of said loading funnel means.

12. The commercial bleaching apparatus of claim 1 wherein the interior of said outer wall means is axially divided into a series of modules defining said prescour, bleach and rinse zones, and said inner wall means have two sections thereof rotatably disposed in each of said modules.

13. The commercial bleaching apparatus of claim 12 wherein said prescour zone is defined by one of sad module, said bleach zone is defined by three of said modules and said rinse zone is defined by one of said modules.

14. The commercial bleaching apparatus of claim 1 further comprising extractor press means disposed adjacent said open outlet end of said drum structure and operative to receive successive batches of bleached textile goods discharged therefrom and remove water from the discharged batches.

15. The commercial bleaching apparatus of claim 14 further comprising circulating pump means operative to transfer from said extractor press means to said rinse zone water removed from textile goods received by said extractor press means.

16. Commercial bleaching apparatus comprising:

a horizontally disposed drum structure having an open inlet end into which textile goods to be bleached may be inserted, and an open outlet end through which bleached textile goods may be discharged, said drum structure having stationary hollow cylindrical outer wall means, and perforated hollow cylindrical inner wall means concentrically disposed within said outer wall means and being operatively drivable relative thereto in a manner alternatively oscillating said inner wall means through a rotational arc of approximately 240° and then rotating said inner wall means through a full 360° arc, the interior of said outer wall means being axially divided into a prescour zone positioned at said inlet end and bleach rinse zones positioned downstream of said prescour zone, and the interior of said inner wall means being divided into axial sections received in said prescour, bleach and rinse zones, said inner wall means, in response to successive rotations thereof through full 360° arcs, being operative to axially shift textile goods from section to section thereof, toward said open outlet end, and then outwardly through said open outlet end;

drive means for operatively driving said inner wall means relative to said outer wall means at a rotational speed of approximately 5 RPM;

makeup means for continuously flowing water through said prescour and rinse zone and then to waste in a manner maintaining essentially constant, equal heights of water in lower side portions of said prescour and rinse zones and in the sections of said inner wall means disposed therein;

recirculating means for maintaining an essentially constant height of water in said bleach zone essentially equal to the water heights in said prescour and rinse zone, said makeup means and said recirculating means being operative to maintain volumes of water in said prescour, bleach and rinse zones equal to from about 25% to about 30% of the total volumes of said prescour, bleach and rinse zones, said recirculating means including means for periodically transferring water from said rinse zone back into said bleach zone;

heating means for heating water disposed in said prescour, bleach and rinse zones, said heating means being operative to maintain water temperatures within said drum structure that progressively decrease from said bleach zone to said rinse zone; and means for selectively adding a bleaching agent to said bleach zone.

17. The commercial bleaching apparatus of claim 16 wherein said heating means are operative to maintain a water temperature of approximately 150° F. in said prescour zone, a water temperature of approximately 200° F. in said bleach zone and a water temperature ranging from about 180° F. to about 130° F. in said rinse zone.

18. The commercial bleaching apparatus of claim 16 wherein said commercial bleaching apparatus further comprises loading funnel means connected to said open inlet end of said drum structure for receiving successive batches of textile goods to be bleached and delivering the batches into the inlet end section of said inner wall means, and said means for periodically transferring water from said makeup water tank back into said bleach zone include circulating pump means operative to intermittently deliver water from said makeup water tank to the interior of said loading funnel means.

19. The commercial bleaching apparatus of claim 16 further comprising extractor press means disposed adjacent said open outlet end of said drum structure and operative to receive successive batches of bleached textile goods discharged therefrom and remove water from the discharged batches, and circulating pump means operative to transfer from said extractor press means to said rinse zone water removed from textile goods received by said extractor press means.

20. The commercial bleaching apparatus of claim 16 wherein said drum structure is the drum structure of a tunnel type continuous batch washer.

* * * * *